United States Patent [19]

Aliprandi et al.

[11] 4,056,217

[45] Nov. 1, 1977

[54] SLIDING GATE VALVE FOR MOLTEN METAL WITH ADJUSTABLE PLATES

[75] Inventors: Giovanni Aliprandi, Genoa; Roberto Ricci, Genoa-Pegli, both of Italy

[73] Assignee: SNAC S.p.A. Refrattari Argille e Caolini, Italy

[21] Appl. No.: 637,964

[22] Filed: Dec. 5, 1975

[30] Foreign Application Priority Data

Apr. 24, 1975 Italy ..... 12585/75

[51] Int. Cl.[2] ..... B22D 37/00

[52] U.S. Cl. ..... 222/600; 222/512; 251/144

[58] Field of Search ..... 222/559, 561, 600, 598, 222/512; 251/144

[56] References Cited

U.S. PATENT DOCUMENTS

| | | | |
|---|---|---|---|
| 311,902 | 2/1885 | Lewis | 222/600 |
| 3,727,805 | 4/1973 | Shapland | 222/600 |
| 3,765,579 | 10/1973 | Cramer et al. | 222/600 |
| 3,786,969 | 1/1974 | Kelly | 222/600 |
| 3,856,189 | 12/1974 | Meier | 222/600 X |
| 3,942,690 | 3/1976 | Lohrer | 222/600 |
| 3,968,909 | 7/1976 | Meier | 222/600 |

*Primary Examiner*—Robert B. Reeves
*Assistant Examiner*—David A. Scherbel
*Attorney, Agent, or Firm*—Robert E. Burns; Emmanuel J. Lobato; Bruce L. Adams

[57] ABSTRACT

A box discharger for a large size container of liquid metal, can be mounted on the container and dismounted therefrom, by a single operator, with the aid of tiltable mounting means for mounting frames of stationary and slidable refractory plates on the container. The plates are held to the frames by a set-screw structure.

7 Claims, 2 Drawing Figures

SLIDING GATE VALVE FOR MOLTEN METAL WITH ADJUSTABLE PLATES

BACKGROUND OF THE INVENTION

Object of the present invention is a box intercepting device particularly suitable for large containers of smelted metal.

It is known that containers of smelted metal have a lower discharge conduit which, up to some years ago, was generally kept closed through a casting rod coated with refractory. Such a casting rod is difficult in use and, as soon as high quality refractories became available, it was subsequently and gradually replaced with box intercepting devices the first embodiments of which, though not of common use, appeared some dozens of years ago.

Said box intercepting devices generally include a refractory plate supported by a metal frame and provided with a hole, said plate is slidable against a stationary refractory plate carried by a metal frame and provided with a hole arranged correspondingly to the outlet of the container of smelted metal.

The assignees of this invention patented various box dischargers of the above type which gave up to now very good results.

It is however to be noted that the refractory materials used in said box discharger are to be replaced periodically as soon as their wear degree is over a given level.

To this end, according to a previous patent of the assignees, the stationary refractory plate was blocked against the bottom of the smelted metal container through displaceable and adjustable guides, while the refractory plate slidable against the previous one for allowing alternatively the closing and opening of the casting hole was arranged in a tilting frame so as to replace it readily.

Such an arrangement, though very good under the operative point of view, requires at least two operators to mount and dismount it, if the size of the casting hole, corresponding to the size of the liquid metal container, is relatively large.

Up to now, the box dischargers of the above type have been used with good results in medium size containers of liquid metal.

OBJECT OF THE INVENTION

In consideration of the present increase in size of said liquid metal containers, the invention aims at providing a constructive solution for said box dischargers which, keeping the good operative features, could allow a single operator to mount and dismount them.

SUMMARY OF THE INVENTION

The improved intercepting box device, particularly suitable for large containers of smelted metal, is of the type comprising a discharger including at least two refractory elements, one of which is slidable in contact with the other stationary element so as to allow the alignment in the opening step and the staggering in the closing step of holes provided in both the sliding element and stationary element. The sliding refractory elements are in form of plates and each is supported by a metal frame. The metal frame carrying said sliding refractory element is supported by a third and stationary metal frame provided with sliding guides. According to the invention both said first frame carrying the stationary refractory plate, and the unit consisting of the third frame, the second frame and the sliding refractory plate are individually tiltable about a horizontal axis arranged at one of the ends of said unit.

The improved intercepting device comprises further the feature that the tilting axis of the first metal frame, carrying the stationary refractory plate, and the tilting axis of the third frame carrying the sliding second frame together with the second refractory plate are arranged at 90°.

The improved intercepting device comprises also the feature that the sides of the first stationary frame are passed through by pressure screws or set screws which, through leaf springs and positioned listels, press against the edges of the first refractory plate.

In the improved intercepting device the first metal frame may be locked in horizontal position against the bottom of the liquid metal container through nuts which may be screwed on studs projecting from the bottom of said container.

In the improved intercepting device the sides of the second metal frame sliding integrally with the second refractory plate, are passed through by pressure screws which, through leaf springs and positioning listels, press against the edges of the second refractory plate.

In the improved intercepting device the second metal frame sliding integrally with the second refractory plate is provided with longitudinal edges sliding within corresponding longitudinal guides arranged on the longitudinal sides, and inside thereto, of the third metal frame.

In the improved intercepting device the second metal frame sliding integrally with the second refractory plate is provided with catching means for the connection to the end of a horizontal control rod which transmits to its the positioning motion to establish the opening position or the closing position of the intercepting device.

In the improved intercepting device the third metal frame, tiltable about a horizontal axis parallel to one of the sides thereof, is provided correspondingly to the opposed side with a vertically slit projection suitable to receive a support pivot carried by the bottom of the liquid metal container.

In the improved intercepting device the third metal frame may be locked in an adjustable horizontal position by means of nuts provided with washers having the contact surface in form of spherical bowls; wherein said nuts are screwed on the threaded body of threaded members connected in articulated manner to the bottom of the container.

BRIEF DESCRIPTION OF THE DRAWINGS

The invention will be now described by way of example with reference to the accompanying drawings, wherein.

DESCRIPTION OF A PREFERRED EMBODIMENT

Figure 1:
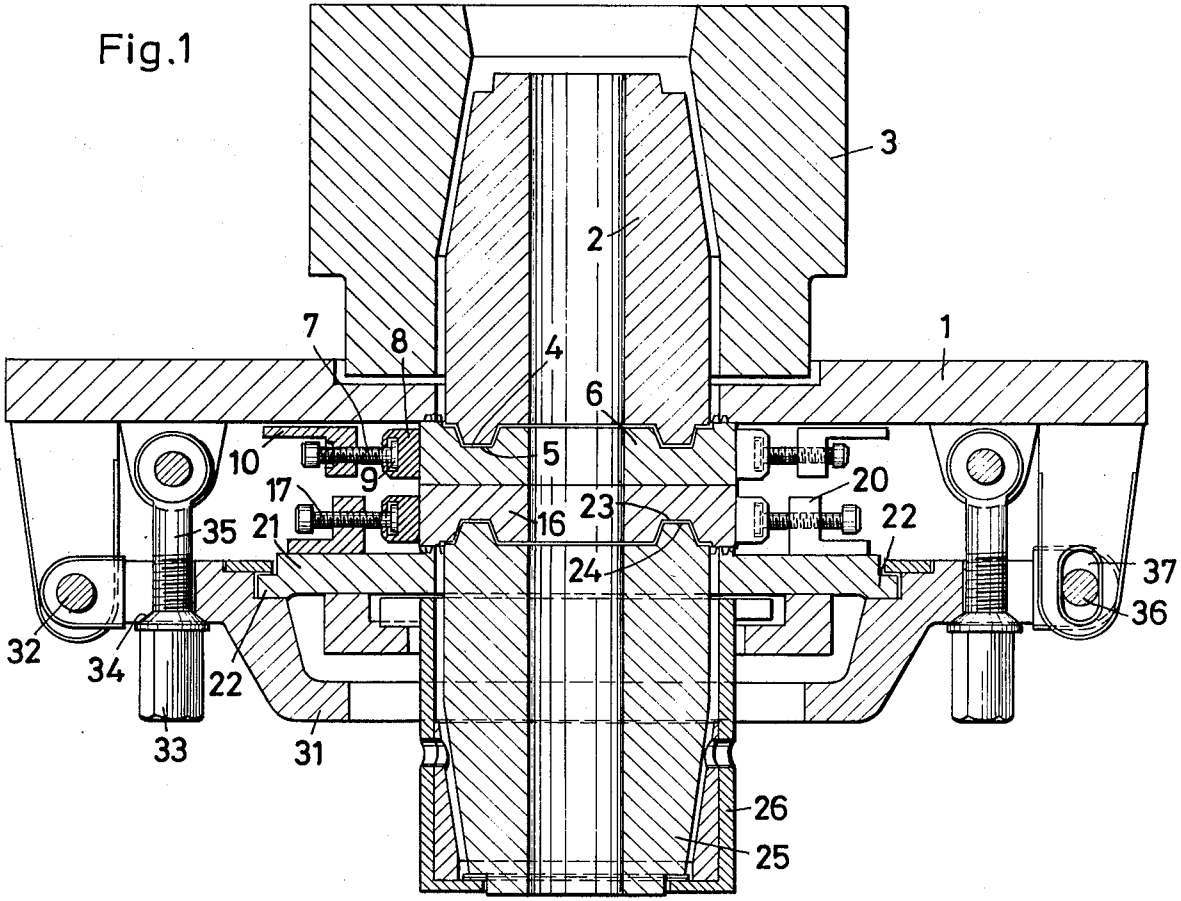
FIG. 1 is a vertical section of the device according to the invention seen perpendicularly to the sliding direction of the sliding refractory plate.
Figure 2:
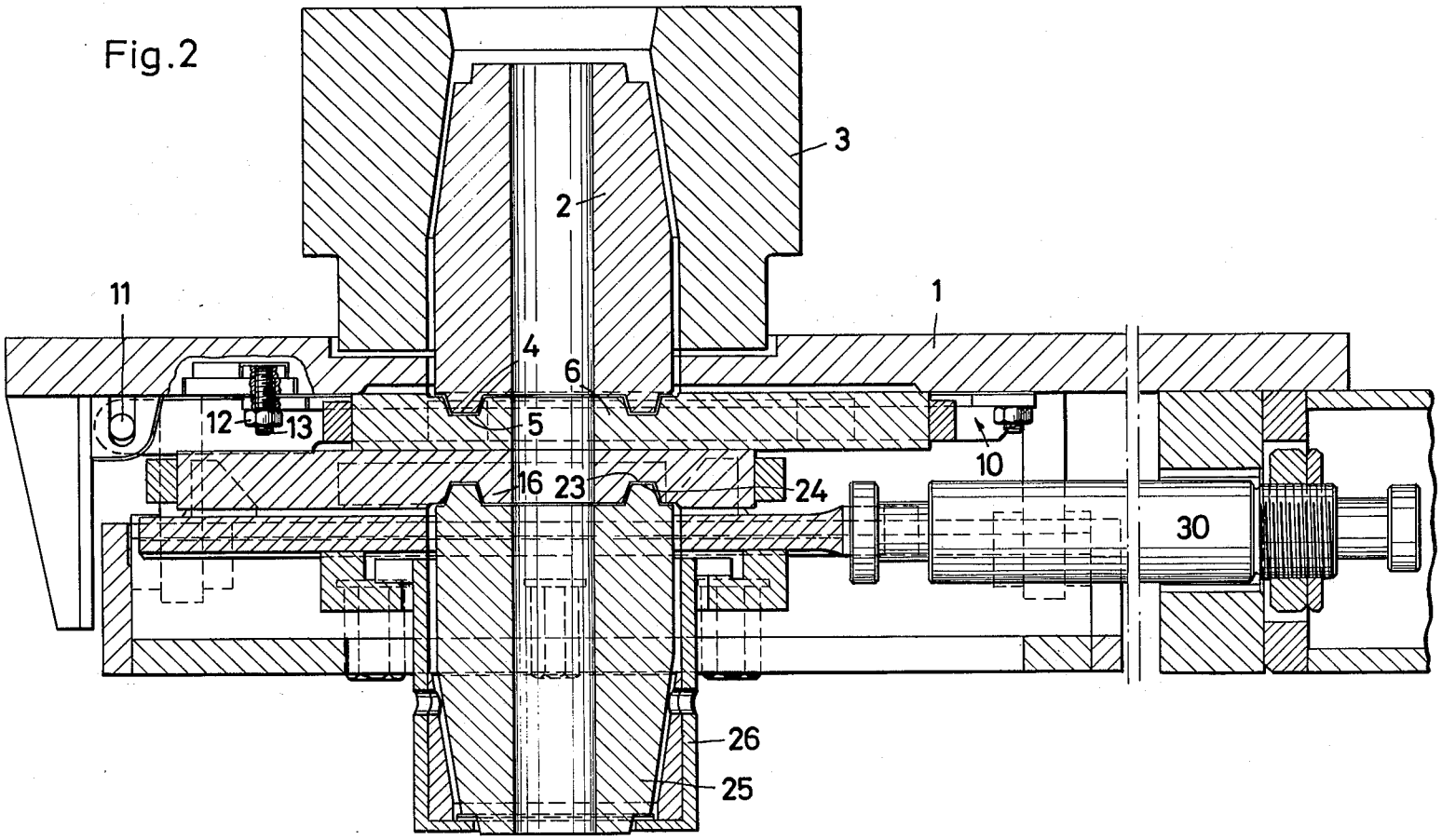
FIG. 2 is a vertical section perpendicular to the previous one.

In the drawings, numeral 1 denotes the metal bottom of a smelted metal container; inside the container is coated conventionally with refractory material, though the latter is not shown. Correspondingly to the casting hole, the refractory coating consists of an annular element or discharger 2 removable from outside and from the container bottom for replacing it when its wear exceeds a certain extent. To this end discharger 2 is tapered upwards and is inserted in a second annular refractory element 3 with a longer life, removable for replacement from the top, that is from inside the container of smelted metal.

For removing said discharger 2, the container metal bottom 1 is provided with a hole, with a diameter larger than the outer diameter of discharger 2, and said discharger 2 projects slightly from the bottom 1 of the ladle or container for entering, with an annular rib 4, a corresponding annular groove 5 provided on the upper face of a refractory plate 6 which remains locked against the container bottom 1 when the box discharger is in operation. Plate 6 will be called from now on the stationary refractory plate.

For this purpose, the stationary refractory plate 6 is kept still by pressure screws or set screws 7 acting on the edges thereof by means of metal listels 8 through leaf springs denoted only diagrammatically in section by numeral 9. At their other end, said pressure screws 7 are screwed in threaded holes provided on the sides of a stiff metal frame 10.

Said stiff frame 10 is articulated at 11 to the container bottom 1 and normally held thereto by means of a suitable set of nuts 12 which are screwed on correspondingly threaded studs 13 projecting from the container bottom 1.

Supposing that the part of the discharger placed below the stationary plate 6 has been anyhow removed, it is clear that for replacing said stationary refractory plate 6 it is sufficient to remove said nuts 12 and then rotate downwards the whole consisting of plate 6 and frame 10 which will remain suspended to the bottom 1 of the container by means of the above articulation 11. Now, ever a single operator will be in position to loosen screws 7, remove the worn plate 6 and replace it with a new refractory plate 6; then he will tighten again said screws 7 and rotate the whole 6–10 upwards against bottom 1 to which said whole will be fastened through said nuts 12. The entire operation may thus be effected by a single person.

Against the stationary refractory plate 6 rests in a slidable position the movable refractory plate 16 which is kept in position by screws 17 through plaques and leaf springs, in a manner similar to the one for the stationary refractory plate 6.

Said screws 17 are screwed in threaded holes provided in a frame 20 mounted on a metal plate 21 slidable by means of side guides 22. Like the stationary plate 6, the slidable refractory plate 16 has a hole in the centre and on the underside of the plate, around said hole, is provided a positioning groove 23 housing a circumferential rib 24 provided on the upper base of a refractory sleeve 25, the latter being supported below the slidable refractory plate 16 by a metal cylinder 26 suitably supported on its turn below said slidable metal plate 21.

It is to be noted that said sleeve 25 and discharger 2 are equal, as well as said refractory plates 6 and 16 which moreover are supported in the same way. That has no importance from the point of view of the box discharger operation, but is very useful for the reduction of the stocks and for the interchangeability of the pieces.

As a matter of fact, according to the invention, the refractory pieces to be replaced are only four, equal two by two.

The whole consisting of the slidable refractory plate and the relevant support metal plate is controlled, as for the movement, in known manner through a rod 30.

Through said guides 22 the metal plate 21 is carried by a horizontal frame 31 which, like frame 10, is articulated at 32 to the container bottom 1.

In order to keep said lower frame 31 in the correct horizontal operative position, there are nuts 33, provided with washers 34 in form of spheric caps, which may be screwed on screws 35 fixed in an articulated manner to the container bottom 1. Said screws 35, though having a similar function as screws 13, are on the contrary articulated to said bottom 1 in view of the greater need of adjustment of the whole 31, 21, 16, 25 in comparison to the whole 6, 10. On the side opposite to the one of articulation 32, said frame 31 has a removable pin 36 which may be inserted into a slot 37 in a bracket integral with bottom 1, which serves to fasten roughly the position of frame 31, leaving the operator free of the weight of said frame 31.

This further facilitates the task of a single person operating the new, large discharger notwithstanding its heavy weight.

Further, it is to be noted that the articulation axis 32 of said frame 31 is perpendicular to the articulation axis 11 of said frame 10, so as to make it easier to arrange the screws 7, 17 fixing the correct position of said two refractory plates 6 and 16.

Finally, it is to be appreciated that thanks to the correct positioning, obtainable through the leaf springs, there is no need of liquid cementing means which need to be dried for fastening plates 6 and 16 and sleeves 3 and 25. That means a further saving of time for positioning the plates and replacing them.

It is to be understood that the invention is not limited to the example shown. It is intended to cover all modifications and equivalents within the scope of the appended claims.

What we claim is:

1. A device for discharging smelted metal from a container, comprising;

a first discharger plate unit, secured in use to a container comprising a first and stationary metal frame and a first and stationary refractory plate normally supported thereby and having a discharge hole;

first mounting means for tiltably mounting the first plate unit on the container;

a second discharger plate unit comprising a second metal frame and a second refractory plate normally supported thereby and having a discharge hole;

second mounting means for mounting the second unit for sliding movement of the second plate along and in contact with the first and stationary plate to mutually align the holes in an opening step of the sliding movement and to place the holes out of mutual alignment in a closing step thereof, the mounting means comprising a third, normally stationary metal frame secured to the container and having elongate mutually parallel guides, the second frame having edges slidable along the parallel guides, the second mounting means also comprising means for tiltably mounting the third frame and thereby the guides and the second frame on the container; and first and second plate mounting means, each comprising a plurality of set screws threaded into a respective frame, engageable and disengageable with the respective refractory plate, sides of the respective frame sliding integrally with the respective refractory plate and having leaf springs and positioning listels co-operating with said screws to press them against edges of the respective refractory plate.

2. A device according to claim 1 in which the first mounting means also includes a plurality of studs secured to the container and engageable with the first metal frame, and nuts threadedly engageable with the studs to releasably hold the first metal frame against the container.

3. A device according to claim 1, wherein the means for tiltably mounting the third metal frame comprises a pivot secured to the container, the third frame also having, opposite the pivot, a projection secured to the container and having a vertical slot, and a supporting pin engageable with the slot to support the third metal frame.

4. A device according to claim 3, wherein said second mounting means also includes a plurality of studs secured to the container, and nuts threadedly engageable with the studs to additionally support the third frame.

5. A device according to claim 4 wherein each nut has a washer which has a spherical contact surface, the third frame having matching contact surfaces for engagement with the nuts through the washers.

6. A device according to claim 5 wherein each stud is tiltably secured to the container to facilitate said engagement.

7. A device according to claim 1, wherein said first and second refractory plates are mutually interchangeable.

* * * * *